US010491981B1

(12) United States Patent
Wang et al.

(10) Patent No.: US 10,491,981 B1
(45) Date of Patent: Nov. 26, 2019

(54) ACOUSTIC IN EAR DETECTION FOR A HEARABLE DEVICE

(71) Applicant: Apple Inc., Cupertino, CA (US)

(72) Inventors: Hongfeng Wang, Cerritos, CA (US); Chen Na, Cerritos, CA (US); Ryan M. Moriyama, Santa Monica, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/221,370

(22) Filed: Dec. 14, 2018

(51) Int. Cl.
*H04R 29/00* (2006.01)
*H04R 1/10* (2006.01)
*H04R 1/08* (2006.01)

(52) U.S. Cl.
CPC ..... *H04R 1/1041* (2013.01); *H04R 1/08* (2013.01); *H04R 1/1016* (2013.01); *H04R 29/001* (2013.01); *H04R 2420/07* (2013.01)

(58) Field of Classification Search
CPC ..... H04R 29/00
See application file for complete search history.

(56) References Cited

U.S. PATENT DOCUMENTS 7,406,179 B2 * 7/2008 Ryan ..... H04R 1/10 381/312
8,401,200 B2 3/2013 Tiscareno et al.
2006/0045304 A1 3/2006 Lee et al.
2007/0121974 A1 * 5/2007 Nemirovski ..... H04R 1/1016 381/312
2009/0264161 A1 * 10/2009 Usher ..... H04M 1/22 455/570
2010/0128887 A1 * 5/2010 Lee ..... H04R 1/1041 381/74
2011/0116643 A1 5/2011 Tiscareno et al.
2013/0195299 A1 8/2013 Iseberg et al.
2013/0345842 A1 * 12/2013 Karakaya ..... H04R 5/04 700/94
2015/0310846 A1 10/2015 Andersen et al.
2016/0273986 A1 * 9/2016 Neubarth ..... G01L 9/0073
2017/0094389 A1 * 3/2017 Saulsbury ..... H04R 1/1016
2017/0347180 A1 11/2017 Petrank
2019/0052951 A1 * 2/2019 Kofman ..... H04R 1/1016

FOREIGN PATENT DOCUMENTS

CN 102293013 A 12/2011

* cited by examiner

*Primary Examiner* — Olisa Anwah
(74) *Attorney, Agent, or Firm* — Womble Bond Dickinson (US) LLP

(57) ABSTRACT

A method for determining a current usage state of an earphone that includes a speaker and an air pressure sensor. The method obtains a pressure signal from the air pressure sensor that indicates air pressure proximate to the earphone, the air pressure sensor produces the pressure signal in response to the earphone being inserted into an ear of a user. The method processes the obtained pressure signal to determine that the earphone is in a state of use, and in response, performs at least one of (1) outputting an audio signal through the speaker signifying that the earphone is in use (2) establishing a wireless connection with a media playback device to exchange data between the earphone and the media playback device, or combination thereof.

20 Claims, 6 Drawing Sheets

ACOUSTIC IN EAR DETECTION FOR A HEARABLE DEVICE

FIELD

An aspect of the invention relates to a hearable device for determining that it is in a state of use based on changes in air pressure. Other aspects are also described.

BACKGROUND

Headphones are an audio device that includes a pair of speakers, each of which is placed on top of a user's ear when the headphones are worn on or around the user's head. Similar to headphones, earphones (or in-ear headphones) are two separate audio devices, each having a speaker that is inserted into the user's ear. Both headphones and earphones are normally wired to a separate playback device, such as an MP3 player, that drives each of the speakers of the devices with an audio signal in order to produce sound (e.g., music). Headphones and earphones provide a convenient method by which the user can individually listen to audio content, without having to broadcast the audio content to others who are nearby.

SUMMARY

Wireless hearable devices, such as wireless earphones, provide a user with the capability to individually listen to audio content (e.g., music) or conduct a telephone communication without broadcasting sound to others who are within close proximity. To perform such operations, the earphones wirelessly connect or pair, via for example BLUETOOTH protocol, with a separate electronic device, such as a smartphone to wirelessly exchange audio data. Before initializing a wireless connection with the smartphone, however, the earphones confirm that they are being worn by the user, who by wearing the earphones intends to pair them with the smartphone. Some wireless earphones perform a confirmation process using proximity sensors that monitor proximity data to determine if a distance between the earphones and an object (e.g., a head of the user) is below a threshold distance, thereby indicating that the earphones are being worn. Relying on proximity data, however, has drawbacks. For instance, the proximity data only indicates the distance between the earphones and another object, but the data does not give any indication of the nature of the object, thus being susceptible to false positives (e.g., when being held in a user's hand or in a pocket of the user). Other wireless earphones rely on an increase in occlusion gain that is caused when a stimulus sound (e.g., low frequency sound) is produced by the main speaker of the earphones, when the earphones are inserted into a user's ear canal. These earphones include a tip that when inserted into a user's ear canal, creates an air tight seal. When the stimulus sound is produced in the sealed environment, a microphone senses an increase in a low frequency response that indicates the earphone is inside the user's ear. This method, however, relies on a near perfect air tight seal being created by the tip. If a seal is less than perfect the low frequency response will suffer, thereby providing inconclusive results and possibly false positives.

An aspect of the invention is a method performed by an earphone for confirming that the earphone is to be activated (e.g., wirelessly paired with a media playback device) by determining a current usage state of the earphone. This is accomplished through the use of an air pressure sensor that is inserted, along with a speaker of the earphone, into the ear canal of the user. The air pressure sensor produces an air pressure signal that indicates the air pressure within the ear canal, as the earphone is being inserted into the ear of the user. During, and after insertion, the air pressure sensor detects changes in the air pressure within the ear canal, with respect to ambient atmospheric pressure. These changes are caused by the tip of the earphone when it creates a seal within the ear canal and compresses the volume of air while the earphone is being inserted into the ear. The earphone processes the air pressure signal to detect changes in the air pressure signal, such as pulses that are indicative of a user inserting the earphone into the user's ear. Upon detecting such changes, it is determined that the earphone is in a state of use being inside the ear of the user, and in response, the earphone activates. For example, the earphone may output an audio signal (e.g., a start-up sound) through the speaker signifying to the user that the earphone is in use. Upon activation, the earphone may also establish the wireless connection (e.g., pair) with the media playback device to exchange data.

By using changes in air pressure to determine that the earphone is in a state of use, it alleviates any false positives that would otherwise occur with other methods. For example, unlike proximity sensors that would create a false positive when the earphone is inside a user's pocket, air pressure sensors would be less susceptible to these occurrences because such an environment creates little change in air pressure. Changes in pressure are proportionally related to changes in the volume of air. In the case of a user's pocket, there would be very little change in air volume, since air may travel freely through the pocket (e.g., because the pocket is made of breathable material). The present invention also has several advantages over other methods that use the increase in occlusion gain to determine that the earphone is inside the user's ear. For instance, unlike the occlusion gain method that requires a main speaker of the earphone to produce a stimulus sound, the earphone of the present invention relies on the air pressure change within the ear canal, without the need of a stimulus sound, thereby saving power that would otherwise be required to activate the main speaker. Also, as opposed to an increase in occlusion gain that requires an air-tight seal to be made within the ear canal of the user in order to be effective, the air pressure sensor of the present invention can accurately detect changes in air pressure to determine that the earphone is in a state of use, even though the seal created by the tip of the present invention is not air tight.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects of the invention are illustrated by way of example and not by way of limitation in the figures of the accompanying drawings in which like references indicate similar elements. It should be noted that references to "an" or "one" aspect of the invention in this disclosure are not necessarily to the same aspect, and they mean at least one. Also, in the interest of conciseness and reducing the total number of figures, a given figure may be used to illustrate the features of more than one aspect of the invention, and not all elements in the figure may be required for a given aspect.

DETAILED DESCRIPTION

Several aspects of the invention with reference to the appended drawings are now explained. Whenever the shapes, relative positions and other aspects of the parts described in the aspects are not explicitly defined, the scope of the invention is not limited only to the parts shown, which are meant merely for the purpose of illustration. Also, while numerous details are set forth, it is understood that some aspects of the invention may be practiced without these details. In other instances, well-known circuits, structures, and techniques have not been shown in detail so as not to obscure the understanding of this description.

Figure 1:
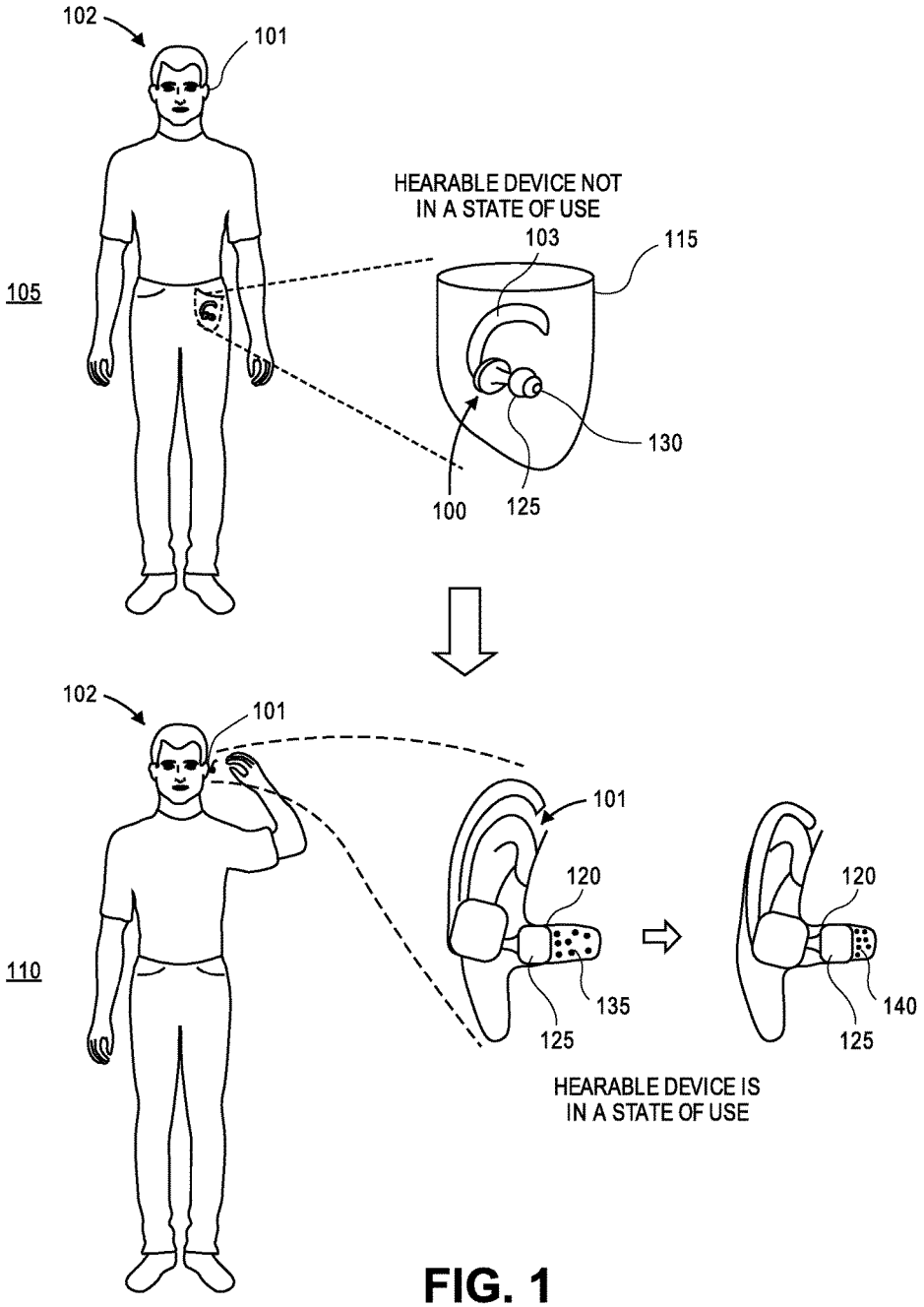
FIG. 1 shows a progression of states of a hearable device, leading to acoustically detecting that the hearable device is in a state of use.

FIG. 1 illustrates a hearable device 100 that activates in response to detecting a change in air pressure as it is inserted into an ear 101 of a user 102. Specifically, this figure illustrates two stages 105 and 110 in which the hearable device 100 is taken out of a pocket 115 of the user 102, and inserted into the user's ear 101, in order for the user 102 to use the hearable device 100 (e.g., listen to music).

As used herein, a "hearable device" may refer to any in-ear, on-ear, or over-ear electronic audio device that is designed to output one or more audio signals through a speaker integrated therein. Examples of hearable devices may include earphones (or in-ear headphones), on-ear or over-ear headphones, or ear implants, such as hearing aids. In this figure, the hearable device 100 is an earphone that is configured to detect changes in air pressure to determine that the hearable device 100 is in a "state of use," in which the user 102 has inserted the hearable device in an ear canal 120 of the user's ear 101. As further used herein, a "state of use" may define a state when a hearable device is placed on, over or in position with respect to one or more portions of a user's head or ears. For example, in one aspect, an on-ear device is in a state of use when at least a portion of the headphone is on the user's ears (e.g., a cushion of the device is resting on the user's ear). An over-ear device is in a state of use when at least a portion of the device is over the user's ear (e.g., an ear cup of the device is over the user's ear, with an earpad of the ear cup resting on a side of the user's head).

While in this state, the hearable device 100 is capable of performing one or more networking and/or audio processing operations. For instance, the hearable device 100 may establish a wireless connection with a media playback device (not shown), such as a smart phone, a tablet, a laptop, etc., over a wireless computer network, using e.g., BLUETOOTH protocol or a wireless local area network. During the established wireless connection, the hearable device 100 may exchange (e.g., transmit and receive) data packets (e.g., Internet Protocol (IP) packets) with the media playback device. In one aspect, this wireless connection is pairing the hearable device 100 with the media playback device in order to allow the hearable device 100 to perform operations that may otherwise be performed at the media playback device. For example, the user 102 may participate in a handsfree phone call that is initiated by the media playback device, but conducted through the hearable device 100. For instance, the hearable device 100 may receive an audio signal from the media playback device that includes the audio of the phone call, which the hearable device 100 plays back (e.g., renders and outputs) through a speaker. In conjunction with playing back the audio signal, the hearable device may include a microphone that is configured to sense sound (e.g., speech of the user 102) and convert the sound into a microphone signal, which is then transmitted back to the media playback device to be substituted for sound captured by a microphone of the media playback device for the phone call. More about the capabilities of the hearable device 100 is described herein.

The hearable device 100 includes an ear clip (or ear loop) 103, a tip 125, and an air pressure sensor 130. In one aspect, the hearable device 100 also includes a speaker (not shown). The ear clip 103 is a portion of the hearable device 100 that fits around the back of a user's ear to hold the hearable device 100 in place when worn by the user 102. In one aspect, the hearable device 100 may not include the ear clip 103. The tip 125 is for providing an air tight seal in the ear canal 120 when the hearable device 100 is inserted into a user's ear 101. The seal helps to reduce an amount of external environmental noise from leaking into the ear canal 120 while the hearable device 100 in use. The air tight seal also enables the hearable device 100 to provide a better low-frequency response, thereby providing an overall better sound experience to the user 102. If, however, the seal is not air tight or there was no seal at all, the low frequency response may suffer because as the speaker of the hearable device 100 produces sound, air will escape from the ear canal 120. In one aspect, the tip may be made of any flexible material, such as silicone, rubber, and plastic.

The air pressure sensor 130 is configured to detect air pressure external to the hearable device 100, and in response produce an air pressure signal. The sensor 130 may be of a force collector type that detects pressure due to an applied air force over a force collector (e.g., such as a diaphragm, piston, etc.) and converts the pressure into an electrical signal. For example, the sensor 130 may be a pressure transducer that converts strain on a diaphragm, caused by air pressure, into a corresponding air pressure signal. In one aspect, rather than a specialized electrical component, such as a pressure transducer, the sensor 130 may be a (e.g., reference or voice) microphone, similar to the microphone described in FIG. 2. In another aspect, the air pressure sensor 130 may be a barometer, or any type of sensor that is capable of producing a signal that represents an air pressure.

As previously described, when a conventional hearable device is in a pocket of a user, the device may in fact inadvertently activate while in the pocket 115 of the user 102 (as shown in stage 105 of FIG. 1). For example, conventional hearable devices may activate in response to a proximity sensor detecting that the device is within a threshold distance of an object, such as the side of a person's head. This approach, however, may result in many false positives or erroneous activations of the hearable devices, since most proximity sensors cannot distinguish between the objects from which distance is calculated. In particular, since the hearable device is in the user's pocket 115, which is a confined space, if the hearable device 100 used these methods (e.g., proximity data) to activate, it would most likely do so because the proximity sensor would detect the cloth of the pocket 115 in close proximity. Therefore, proximity sensors alone may not provide an adequate level of confidence that a hearable device is currently in a state of use.

In contrast to conventional approaches, the hearable device 100 does not activate at stage 105 because the air pressure sensor 130 does not detect a change in air pressure while the hearable device 100 is in the pocket 115 of the user 102. In one aspect, while not active, the hearable device 100 may be in a power-save mode, in which operations performed by the hearable device may be reduced to save battery power. While in this mode, however, certain computational operations and/or sensors may remain active, in order to determine whether or not the hearable device is being used (or going to be used) by the user 102. For example, the air pressure sensor 130 may remain active (e.g., producing air pressure signals), and a processor may continue to monitor the air pressure signal to determine when there are changes detected by the sensor 130. More about the air pressure sensor 130 is described herein.

The hearable device 100, as opposed to conventional hearable devices, provides a higher level of confidence that a hearable device is being used, since it relies on changes in air pressure with respect to the air pressure of the environment, rather than whether a detected distance is below a threshold distance. Therefore, the hearable device 100 does not activate while in the user's pocket 115. Under the ideal gas law, air pressure can be defined as $$P=\rho RT$$

where p is the density of the air, R is a constant, and T is temperature. The density of air, ρ, can be defined as $$\rho = \frac{M}{V}$$

where M is the mass of air and V is the volume of the air. As the volume of the air decreases, the air density and therefore the air pressure proportionally increases. In the case of the user's pocket 115, the air pressure signal produced by the air pressure sensor 130 does not signify (e.g., enough of) a change to result in activating the hearable device 100, since the volume of air in the pocket does not substantially change with respect to the environment. This may be due to the fact that the pocket 115 is made out of a breathable material (e.g., cotton) that allows air to flow freely. Therefore, since the sensor 130 does not detect a change in pressure, the hearable device 100 does not activate.

Stage 110 illustrates the hearable device 100 activating upon detecting a change in air pressure that indicates that the hearable device 100 is in a state of use being inside the ear canal 120 of the user 102. Specifically, in this stage, the user 102 has taken the hearable device 100 out from the pocket 115, and put on the hearable device 100 in order to use it (e.g., during the handsfree phone call). In this situation, as opposed to when the hearable device 100 is in the user's pocket 115, the hearable device detects a change in air pressure. For example, as illustrated in this stage, the user 102 places the hearable device 100 at the entrance of the ear canal 120. As shown, the tip 125 of the hearable device 100 creates a seal that prevents air from escaping. While the tip 125 is at the entrance of the ear canal 120, the canal has an air volume 135 (shown as black dots spaced apart from one another). As the hearable device 100 is positioned onto the ear 101, the tip 125 traverses through the ear canal 120, until it is fully inserted. At this point, the volume of air 140 is lower than the air volume 135, when the tip 125 was at the entrance of the ear canal 120 (shown as the block dots grouping closer together). With this reduction in the volume of air, the air density has increased, since the air is sealed in the ear canal 120 by the tip 125 of the hearable device 100, resulting in a change (e.g., increase) in air pressure within the ear canal 120.

To further illustrate, when comparing the same substance under two different sets of conditions, Boyle's law indicates the following to be true:

$$P_1V_1=P_2V_2$$

thus, the change in air pressure may be defined as $$P_2 = \frac{P1V1}{V2}$$

As the volume of the ear canal 120 decreases, the pressure in the ear canal 120 will increase proportionally. This increase in pressure is detected by the air pressure sensor 130, resulting in the activation of the hearable device 100.

In one aspect, some conventional hearable devices may detect that the device is in a state of use based on an audio occlusion gain. Specifically, an occlusion of the ear canal will result in an increase or gain in low frequency sound pressure in the ear canal. These conventional devices take advantage of this effect by producing a low frequency stimulus sound (e.g., 20 Hz sound) through a speaker in the ear canal, and if a microphone within the ear canal senses the gain in the low frequency sound pressure, the hearable device is then determined to be in a state of use. These methods, however, rely on the tip of the hearable device creating a near-perfect seal. Otherwise, if some air is allowed to escape from the ear canal during this test, it may result in inconclusive results.

The present disclosure, however, is an improvement to this conventional approach, since the hearable device 100 relies on a change in air pressure within the ear canal 120, which occurs even if the tip 125 does not produce a near-perfect seal. In one aspect, even if air escapes while the hearable device 100 is inserted into the ear canal 120, the air pressure sensor will still detect a change in air pressure as it traverses through the ear canal 120. Thus, the present disclosure provides more accuracy and confidence, than this approach. Another advantage the present disclosure has over this conventional approach is that there is no need to produce a stimulus sound in order to determine whether the hearable device is currently in use. By removing the need to produce a stimulus sound, the present disclosure may perform the same or similar determination while requiring less processing operations, thereby consuming less power.

In the case of over-ear electronic audio devices, the same principles as the in-ear headphones applies with respect to the increase of air pressure when the over-ear electronic audio devices are worn by the user 102. For example, as earpads (or headphone cushions) of the over-ear electronic audio device are positioned over the user's ears 101, they are compressed towards the ear of the user due to tension caused by a headband that connects the (left and right) earpads together, in order to keep the headphones attached to the user's head. This compression causes a reduction in the volume of air in the inner ear (and ear canal), thereby increasing pressure within the inner ear, which may be sensed by an air pressure sensor that is on the inside of the earpads (directed towards the user's ear). The over-ear hearable device may then activate due to the change in air pressure within the inner ear.

Figure 2:
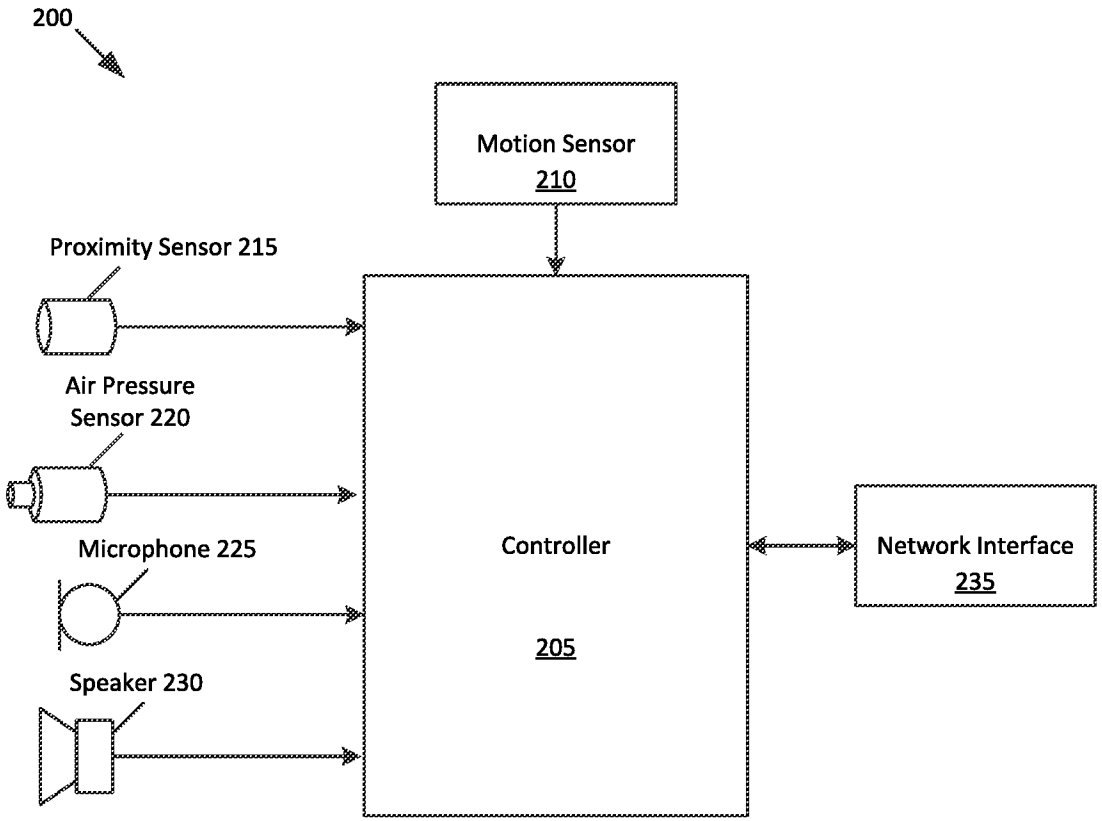
FIG. 2 shows a block diagram of a hearable device according to one aspect of the invention.

FIG. 2 shows a block diagram of a hearable device 200 according to one aspect of the invention. The hearable device 200 includes a controller 205, a motion sensor 210, a proximity sensor 215, an air pressure sensor 220, a microphone 225, a speaker 230, and a network interface 235. In some aspects, each of these elements are integrated into a housing of the hearable device 200. In one aspect, the hearable device 200 may be the same as the hearable device 100 of FIG. 1, such that at least some of the elements included within the hearable device 200 are integrated within the hearable device 100. The hearing device 200 may be any in-ear, on-ear, or over-ear electronic audio device that is capable of outputting one or more audio signals through the speaker 230, capturing sound by the microphone 225, and sensing air pressure using the air pressure sensor 220. In one aspect, the hearable device 200 may be a wireless device, as previously described. For example, the network interface 235 is configured to establish a wireless communication link (e.g., pair) with another electronic device in order to exchange data with the electronic device. For example, the device 200 may pair with another electronic device through any known wireless protocol, such as a BLUETOOTH pairing protocol. In one aspect, the network interface is configured to establish a wireless communication link with a wireless access point in order to exchange data with an electronic server over a wireless network (e.g., the Internet). In some aspects, the hearable device 200 may be a wired audio device, such that the connection between the speaker 230 may be integrated into a housing (e.g., a headphone) that is wired to a playback device. In another aspect, the hearable device may be a wearable device, such as smart glasses, which includes at least one of in-ear, on-ear, and over-ear speakers.

The controller 205 may be a special purpose processor such as an application specific integrated circuit (ASIC), a general purpose microprocessor, a field-programmable gate array (FPGA), a digital signal controller, or a set of hardware logic structures (e.g., filters, arithmetic logic units, and dedicated state machines). The controller 205 is configured to determine whether the hearable device 200 is being used by a user (e.g., when the hearable device 200 is an in-ear device, the hearable device 200 is inserted inside the user's ear, as shown in FIG. 1), and if so, manage processing operations (e.g., network and audio processing operations) that are to be performed as a result of the hearable device 200 being used by a user. The controller is also configured to deactivate the hearable device 200 by limiting an amount of computational operations performed by the hearable device 200 while not in use (e.g., while in the user's pocket 115, as shown in FIG. 1).

In one aspect, the controller 205 is configured to put the hearable device 200 in a power-save mode in order to conserve battery power. Specifically, many operations performed by the hearable device 200 while it is worn by the user require power from a battery (not shown) that is integrated into the hearable device 200. Such operations are not necessary while the hearable device 200 is not worn or used by the user. For example, while the hearable device is in the user's pocket, there is no need to establish a wireless communication link with another device in order to exchange data. As a result, while in the power-save mode, the controller 205 may keep elements of the hearable device, such as the network interface 235, offline in order to conserve power from the battery. In order to exit this mode, thereby activating the hearable device 200, the controller 205 may determine with a high level of confidence that the hearable device 200 is being (or about to be) used by the user. Otherwise, as previously described in conventional approaches, the hearable device 200 may inadvertently activate at times when the user is not wearing the hearable device 200, resulting in a loss in battery power. More about how the controller 205 exits the power save mode with a high level of confidence is later described.

The motion sensor 210 is configured to sense motion of the hearable device 200 and to produce motion data that indicates such movement. The motion sensor 210 may be any sensor that is capable of sensing motion and/or vibration, such as an accelerometer and a gyroscope. The motion data may indicate movement of the hearable device 200 as a change in velocity at which the hearable device 200 is currently traveling. Such movement may be in response to the user taking the hearable device 200 out of a pocket 115, and beginning to move the hearable device 200 towards the ear 101 of the user 102, as shown in FIG. 1.

The proximity sensor 215 is configured to detect a presence of a nearby object that is external to the hearable device 200, and produce a proximity sensor signal that indicates a distance between the object and the hearable device 200. The proximity sensor 215 may be an optical proximity sensor that includes a light emitter that emits a particular wavelength of light (e.g., infrared light). The emitted light strikes the nearby object, and deflected light returning back to the proximity sensor 215 is sensed by a light sensor (e.g., a photodiode) of the proximity sensor 215, which generates an electronic signal based on the returning light. The proximity signal indicates the distance based on a time of flight between the light emitted by the light emitter, and the returning light. In one aspect, the proximity sensor may produce a proximity signal that indicates the distance based on a detection of the intensity of the returning (or sensed) light. Specifically, the returning light will have a higher intensity when reflected off of close objects, while light returned from objects further away will have a lower intensity. In one aspect, the proximity sensor 215 may be any type of proximity sensor 215 that is capable of detecting the presence of a nearby object and its distance from the hearable device 200, such as an inductive, a capacitive, an optical, and an optical proximity sensor. In some aspects, the hearable device 200 may include two or more proximity sensors, each capable of detecting a distance between an external nearby object and the hearable device 200 in similar or different ways as previously described.

The controller 205 is further configured to perform proximity detection algorithms to determine whether a distance between the hearable device 200 and a nearby (external) object that is sensed by the proximity sensor 215 is lower than a threshold distance. The threshold distance may represent a distance from which the hearable device 200 is from a head of the user, when worn by the user. In one aspect, this threshold distance is predefined (e.g., previously determined in a controlled environment). In one aspect, the distance may be a distance learned by the controller 205 as the hearable device 200 is worn by the user over time, for example, using a machine learning algorithm. The threshold distance may be a small distance, e.g., one inch, ¾ an inch, ½ an inch, ¼ an inch, etc., since when worn, the hearable device 200 will be close to a user's head, as shown in stage 110 of FIG. 1. As will be described in FIG. 6, this distance may be small in order to try to limit the number of false positives. As opposed to conventional hearable devices that may use proximity to a nearby device as a determining factor as to whether or not to activate the hearable device, the distance determined by the controller 205 may be a first step to confirm that the user is inserting (or placing) hearable device 200 in (or on) the user's ear. As a secondary confirmation, the air pressure sensor 220 may be used to provide a higher level of confidence that the user is wearing the hearable device 200. More about the air pressure sensor 220 being used as a secondary confirmation is described herein.

The air pressure sensor 220 is to sense (e.g., changes in) air pressure proximate to the hearable device 200. Specifically, the air pressure sensor 220 produces an air pressure signal that includes air pressure data that represents the air pressure within (or around) the user's ear. For example, in the case of an in-ear hearable device, the air pressure sensor 220 may detect changes within the ear canal of the user, as described in FIG. 1. In some aspects, the air pressure sensor 220 senses air pressure within the ear of the user, and produces the air pressure signal in response to the hearable device 200 being inserted into (or placed on top of) the ear of the user. As another example, in the case of an on-ear (or over-ear) hearable devices, the air pressure sensor 220 may detect changes in the inner ear and ear canal, as a whole. In one aspect, the air pressure sensor 220 may be positioned close (e.g., proximate or next) to a speaker 230 of the hearable device 200, since the speaker 230 of the hearable device 200 will be in close proximity to the user's ear. In this case, the air pressure signal indicates the air pressure proximate to the speaker 230 of the hearable device 200. In some aspects, the air pressure sensor 220 may be positioned close to the speaker 230, since the speaker 230 will be either in the ear (in the case of an earphone), or pointed towards the ear (in the case of an on/over the headphone). In one aspect, the air pressure sensor 220 is the same air pressure sensor 130 of FIG. 1. The air pressure sensor 220 sends the air pressure signal to the controller 205 for processing.

The controller 205 is further configured to obtain (receive) the air pressure signal from the air pressure sensor 220, and process the obtained air pressure signal to detect changes within the air pressure signal that represent changes in air pressure. In one aspect, the changes within the air pressure signal are used to determine that the hearable device 200 is being used by the user. For example, the controller 205 is configured to determine if the change in air pressure is above a threshold. If so, it is determined that the hearable device 200 is currently in use. In one aspect, the threshold may be configured to be within a range that is at a particular threshold above the ambient air pressure external to the hearable device 200. Thus, in one aspect, the threshold is configured to be between 0.1% to 10% above the ambient external air pressure that may be sensed through the use of another air pressure sensor (e.g., a reference air pressure sensor) that senses the air pressure external to the device 200. For example, the reference air pressure sensor may sense the air pressure outside the user's ear. In one aspect, the ambient external air pressure may be retrieved through the network interface 235 from another device that is capable of sensing air pressure.

In one aspect, to detect changes in the air pressure signal, the controller 205 determines whether the air pressure signal includes at least one pulse, in which a portion of the signal exhibits one or more rapidly occurring impulses when graphed with respect to time. For example, as shown in FIG. 4, an air pressure signal pulse 402 of the air pressure signal 401 includes a quiet (or steady) portion 421 for a first period of time, a pulse region 422 having a series (e.g., one or more) of impulses for a second period of time, and another quiet (or steady) portion 423 for a third period of time. In one aspect, the pulse 402 may be characterized as the signal increasing to a first amplitude, and then after the second period of time the signal decreases to a second amplitude, which may or may not be the same as the first amplitude. In one aspect, the second period of time (or pulse region width) of the series of impulses may represent the time it takes for the user to insert the hearable device 200 into the user's ear and/or the time it takes for the user to place the hearable device 200 onto the user's ear. More about how the controller 205 processes the obtained air pressure signal in order to detect that the hearable device is in a state of use is described in FIGS. 3-6.

While the hearable device 200 is being used by the user, the controller 205, as previously mentioned performs many additional operations. For example, the controller 205 is configured to interact with the network interface 235. The controller 205 may establish a wireless communication link (e.g., pair) with another electronic device to exchange data over a wireless computer network (e.g., BLUETOOTH or wireless local area network) with the other electronic device. While paired with the other electronic device, such as a media playback device, the electronic device may transmit audio content to be outputted by the speaker 230 of the hearable device 200. In this instance, the controller 205 will receive an audio signal of a piece of audio program content from the network interface 235. The audio signal may be a single input audio channel. Alternatively, however, there may be more than one input audio channel, such as a two-channel input, namely left and right channels of a stereophonic recording or a binaural recording of a music work. Alternatively, there may be more than two input audio channels. In the present case, since there is one speaker 230, when there are multiple input audio channels, in one aspect, the channels may be downmixed to produce a single downmixed audio signal.

In one aspect, the controller 205 is configured to process (or adjust) the audio signal obtained from the network interface 235 (or from local memory), such as perform spectral shaping or dynamic range control upon at least some of the audio signal, create a downmix from multiple channels in the audio signal, perform beamformer processing to produce speaker driver signals for a loudspeaker transducer array (e.g., in the hearable device), perform beamformer processing to produce at least one directional beam pattern from two or more microphone signals produced by a microphone array (e.g., in the hearable device), or other digital processing to produce speaker driver signals that may better "match" the acoustic environment of the hearable device 200 or the speaker capabilities. In one aspect, the controller 205 may process the audio signal according to user preferences (e.g., a particular spectral shape of the audio or a particular volume of the audio). Once the audio signal has been processed by the controller 205, the controller 205 produces a drive signal. The speaker 230 is to receive the driver signal from the controller 205 and use the driver signal to produce sound. The speaker 230 may be an electrodynamic driver that may be specifically designed for sound output at particular frequency bands, such as a subwoofer, tweeter, or midrange driver, for example. In one aspect, playback of an audio signal refers to conversion of the resulting digital speaker driver signals into sound by the speaker 230 that may be integrated within the hearable device 200.

In one aspect, the hearable device 200 may include two or more speakers, such as when the hearable device is a headphone with at least one left speaker and at least one right speaker. In this case, the controller 205 may receive one or more input audio signals and process the signals to produce stereoscopic audio signals and/or binaural audio signals for output through the left and right speakers. In one aspect, the controller 205 may perform spatial audio processing by applying spatial transfer functions (e.g., head-related transfer functions (HRTFs)) to the input audio signals to produce spatial audio through the hearable device's speakers. In one aspect, the HRTFs may be predefined, while in another aspect they may be generated especially for the user's anthropometrics, through any method.

The controller 205 is further configured to process a microphone signal from the microphone 225. The microphone 225 may be any type of microphone (e.g., a differential pressure gradient micro-electro-mechanical system (MEMS) microphone) that will be used to convert acoustical energy caused by sound waves propagating in an acoustic space into an electrical microphone signal. Upon receiving the electrical microphone signal, the controller 205 may perform audio processing operations. For instance, the controller may apply filters (e.g., high pass filters), in order to remove low frequency noise. In one aspect, the controller 205 may perform active noise cancellation (ANC) functions in order to produce an anti-noise signal that when used to drive the speaker 230 cancels noise that leaks into the ear of the user. To perform ANC functions, the hearable device 200 may include at least one of a reference microphone (e.g., to sense ambient sound external to the hearable device 200) and an error microphone (e.g., to sense sound within the ear of the user). In another aspect, the microphone 225 may be used in lieu of the air pressure sensor 220 to detect changes in air pressure. In one aspect, the controller 205 is configured to transmit the microphone signal, via the network interface 235, to another electronic device, such as during a handsfree phone call.

In one aspect, the user may use two independent hearable devices at once, one hearable device for a left ear, and one hearable device for a right ear. In one aspect, both hearable devices may pair separately with an electronic device, such as the media playback device. In another aspect, rather than both hearable devices pairing separately with an electronic device, one of the hearable devices may act as a bridge for the other. For example, a left hearable device may be paired with the media playback device, while the right hearable device is paired with the left hearable device. Such a topology may conserve battery consumption of the right hearable device, since it does not have to produce a strong wireless signal to establish a connection with the media playback device. In one aspect, the topology can change between the hearable devices.

The hearable device 200 may determine that it is in a state of use within a reasonable amount of confidence based on sensor data provided by at least one of the sensors previously described. Although sensor data provided by individual sensors provides a level of confidence (e.g., as with the proximity sensor), a higher level of confidence may be obtained based on sensor data from multiple sensors. As a result, rather than relying on one sensor, such as the proximity sensor which may provide false positives as previously described in FIG. 1, aspects of the present invention use sensor data from at least one of an air pressure sensor, a proximity sensor, and a motion sensor, to name a few. However, in one aspect, rather than using the proximity sensor 215 and the motion sensor 210, the hearable device 200 may determine whether it is in a state of use based solely on the air pressure signal produced by the air pressure sensor 220.

Figure 3:
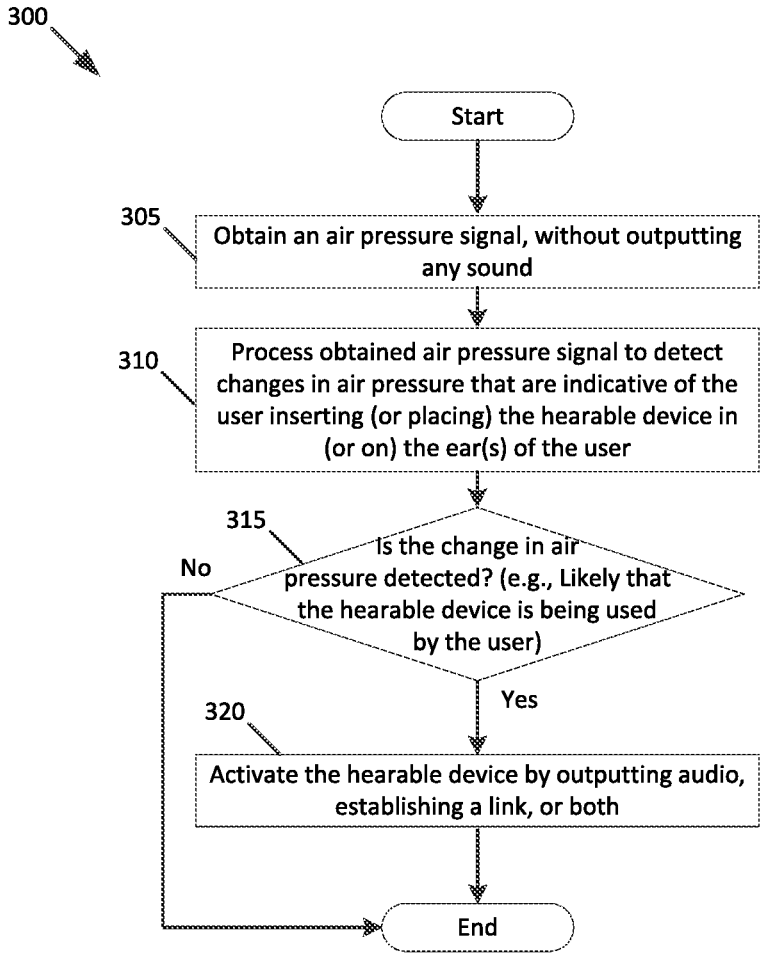
FIG. 3 is a flowchart of one aspect of a process to activate a hearable device based on changes in air pressure.
Figure 4:
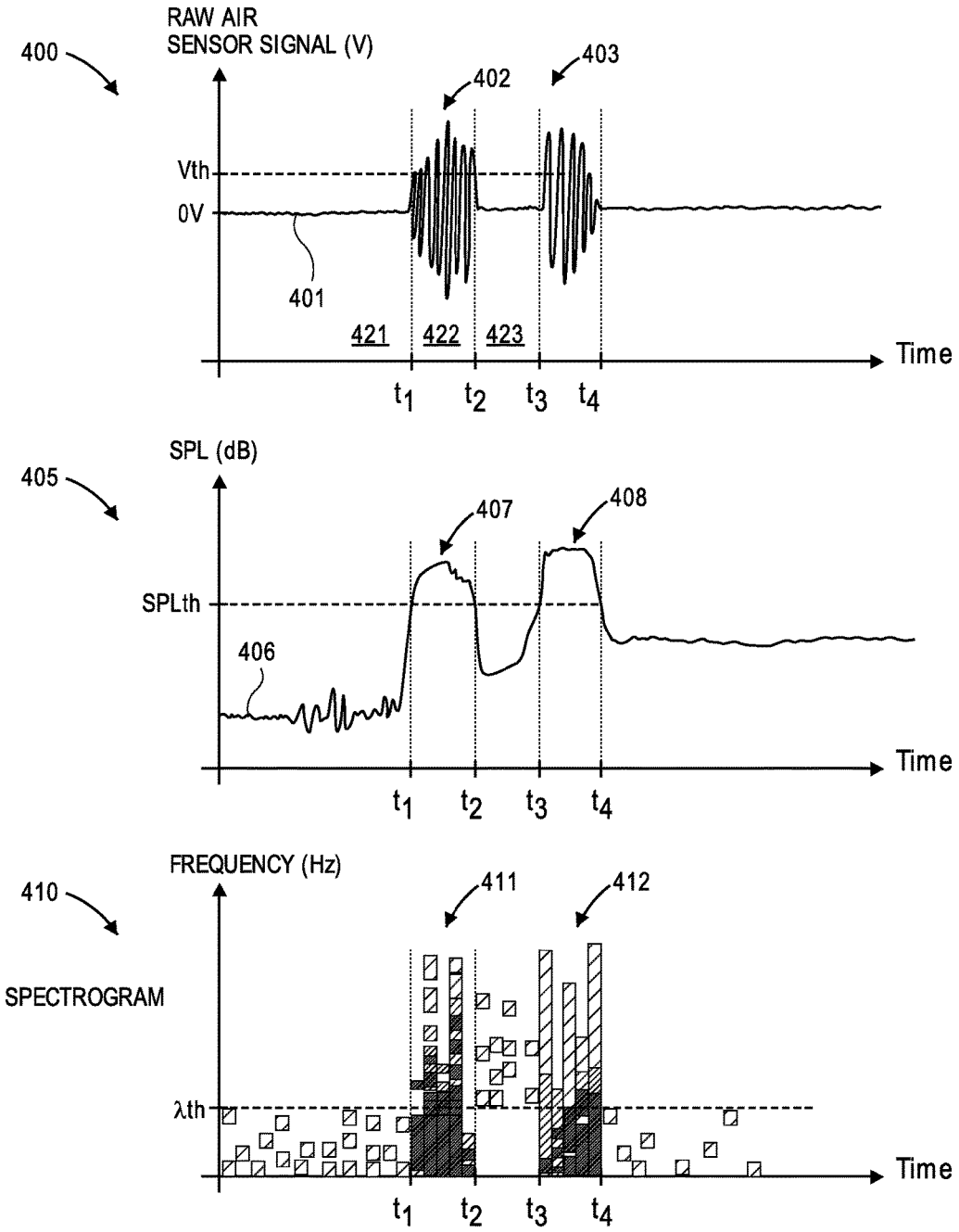
FIG. 4 shows different graphical representations of an air pressure signal produced by an air pressure sensor of a hearable device.

FIG. 3 is a flowchart of one aspect of a process 300 to activate a hearable device upon a determination that the hearable device is in a state of use according to changes in air pressure. In one aspect, the process 300 is performed by either of the hearable devices 100, 200, as described in FIGS. 1-2. The process 300 will be described by reference to FIGS. 2 and 4. In FIG. 3, the process 300 begins by obtaining an air pressure signal from the air pressure sensor 220 that indicates air pressure proximate to the hearable device 200, without the hearable device 200 outputting (or playing back) any sound (at block 305). In one aspect, in the case of the hearable device 200 being an earphone, the air pressure sensor 220 produces the air pressure signal in response to the earphone being inserted into an ear of a user. In another aspect, the air pressure sensor 220 may be activated to sense the air pressure, while the hearable device 200 does not cause the speaker 230 to output sound. In one aspect, the hearable device 200 deactivates the speaker 230 while the air pressure sensor 220 is activated.

The process 300 processes the obtained air pressure signal to detect changes in the air pressure that are indicative of the user inserting the hearable device 200 inside of the ear of the user, or placing the hearable device on top of (or over) the ear of the user (at block 310). In one aspect, the controller 205 may process the air pressure signal in at least one of several methods. For example, the controller 205 may process the obtained air pressure signal to determine if the air pressure within the user's ear is above a threshold value. As another example, the controller 205 may process the obtained air pressure signal to determine whether there is at least one pulse within the air pressure signal. As yet another example, the controller 205 may compute a sound pressure level (SPL) signal of the air pressure signal in order to determine whether there is a SPL pulse. As yet a further example, the controller 205 may look at the spectral content of the air pressure signal (and/or the SPL signal) to determine which frequency bins have the most energy, with respect to other frequency bins.

FIG. 4 shows different graphical representations of an air pressure signal produced by an air pressure sensor 220 of a hearable device 200. Specifically, each of the graphs are different representations of the response of the air pressure signal, when the hearable device 200 is worn by the user, e.g., being inserted into a user's ear and/or placed onto the user's ear.

The controller 205 processes the air pressure signal by looking at different representations of the air pressure signal to identify certain characteristics within each of the representations of the air pressure signal (or drawn from the air pressure signal), which indicate that the user is using the hearable device. For example, the controller 205 may look at the raw air pressure signal, or rather the raw electrical signal that is produced by the air pressure sensor 220 in order to determine (or detect) whether the raw electrical signal has at least one pulse that exceeds a voltage threshold within a period of time.

Graph 400 shows the raw air pressure signal 401 produced by the air pressure sensor 220, with respect to time. In the graph 400, there are two pulses, a first pulse 402 that exceeds a voltage threshold $V_{th}$ within (or over) a period of time $t_1$-$t_2$, and a second pulse 403 that exceeds $V_{th}$ within (or over) another period of time $t_3$-$t_4$. As previously described, the pulse 402 may include a pulse region 422 that is in between two quiet (or steady) portions 421, 423 of the signal 401. By quiet, it is meant that the signal does not fluctuate above (or below) a threshold value (which may be different than $V_{th}$). In one aspect, the threshold value may be a predefined value with respect to the signal 401 (e.g., a voltage above and/or below the signal 401). In some aspects, the threshold value of the quiet portion 421 may be a percentage (e.g., 10%) of the voltage of signal 401. In one aspect, since the raw electrical signal produced by the air pressure sensor 220 may vary in a positive and negative direction, the pulse region 422 of pulse 402 may be defined as a portion of the signal that crosses $V_{th}$ (or $-V_{th}$) at a point in time (e.g., $t_1$) in one direction and then again crosses $V_{th}$ (or $-V_{th}$) at another point in time (e.g., $t_2$) in an opposite direction, where the period of time between both crossings is within a range of time. In one aspect, the pulse region 422 may occupy a portion of the period of time ($t_1$-$t_2$), whereby the last point in time at which the air pressure signal crosses $V_{th}$ (or $-V_{th}$) may be before the end of the period of time, $t_2$. In another aspect, the pulse may also be defined by a number of impulses that cross the $V_{th}$ (or $-V_{th}$) within the period of time.

The pulses may be produced by the air pressure sensor 220 in response to the hearable device 200 being inserted into or placed onto or placed over the ear of the user. For example, referring to FIG. 1, the first pulse 402 may be the result of the hearable device traversing the ear canal 120, since as it traverses the ear canal 120, the air will push against the air pressure sensor 220 in the opposite way from which the hearable device 200 is traveling. In one aspect, the period of time $t_1$-$t_2$ may not directly correspond to the amount of time it takes for the hearable device to traverse the ear canal 120, but instead may be a predefined amount of time in which the controller 205 determines whether the signal includes a pulse (or pulse region). The signal 401 may then level off between the time period $t_2$-$t_3$, when the user has stopped pushing the hearable device 200 inside the ear canal. The second pulse 403 may represent bounce back when the hand of the user releases the hearable device 200. In some aspects, the pulses 402, 403 within the air pressure signal may be in response to user adjustments to the hearable device 200 that is already in use. Specifically, the air pressure sensor 220 may detect a change in air pressure when the user touches or adjusts the fit of the hearable device 200, along with inserting and putting on the hearable device 200. In one aspect, each pulse may be within a time period ranging from 50 milliseconds to 500 milliseconds. In some aspects, each pulse region's width (e.g., $t_1$-$t_2$ and/or $t_3$-$t_4$) may range from 50 milliseconds to 500 milliseconds. The total length of time in which the pulses are detected, $t_1$-$t_4$, may range from 50 milliseconds to two seconds. In one aspect, each pulse 402 and 403 may be within 50 milliseconds to 500 milliseconds. For example, the quiet portion 421, the pulse width 422, and quiet portion 423 of pulse 402 may be within this time period. In one aspect, the quiet portions 421, 423 of pulse 402 may have the same or different widths. In some aspects, rather than having two (or more) pulses, the signal may contain a single pulse. In one aspect, the pulse region may have two pulses. Thus, the controller 205 may determine that the hearable device 200 is in a state of use, when at least one pulse is detected within the raw air pressure signal.

As previously mentioned above, the air pressure sensor 220 may be a pressure transducer that measures the change in air pressure based on movement of a diaphragm. Since movement of a diaphragm may be used to measure air pressure, a microphone, such as a gradient air pressure microphone may be used, instead of a specialized air pressure sensor. Thus, in one aspect, the raw air pressure signal 401 may be a raw microphone signal. In one aspect, the pressure transducer and the microphone may provide a similar air pressure signal.

In some aspects, in addition to (or instead of) determining whether there is a change in air pressure by detecting changes in the raw electrical signal of the air pressure sensor 220, the controller 205 may process the air pressure signal to look at the SPL of the air pressure sensor 220. SPL is a pressure derivation from an ambient atmospheric pressure, caused by a sound wave. SPL indicates the intensity of the sound at the air pressure sensor (or microphone). Specifically, SPL is the ratio of sound pressure caused by a sound wave and an ambient sound pressure (e.g., a known threshold of hearing), measured in logarithmic scale (e.g., dB). In the present case, however, when sensing the air pressure, the change in air pressure is not caused by a sound wave produced by a speaker (e.g., 230). Instead, a computed SPL of the raw signal represents the intensity of a pressure wave that is caused by the vibrations in the air when the user puts in/on the hearable device, or when the user touches the hearable device 200, while it is in/on the user's ear.

Graph 405 shows a SPL signal 406 computed from the raw air pressure signal with respect to time. In this graph 405, the SPL signal 406 includes two pulses, a first pulse 407 that exceeds a $SPL_{th}$ within (or over) the period of time $t_1$-$t_2$, and a second pulse 408 that exceeds $SPL_{th}$ within (or over) the period of time $t_3$-$t_4$. As shown, both pulses 407 and 408 each correspond to pulses 402 and 403, respectively in graph 400, and times $t_1$-$t_4$ of graph 405 correspond to times $t_1$-$t_4$ of graph 400. In one aspect, the $SPL_{th}$ may be a logarithmic value within a range between 20 dB and 50 dB. Similar to the analysis of the raw signal 401, the controller 205 may determine that the hearable device 200 is in a state of use, when there is at least one SPL pulse that exceeds $SPL_{th}$ within the length of time $t_1$-$t_4$. In one aspect, similar to the pulses of graph 400, each pulse 407 and 408 may include a quiet portion in between a pulse region.

In one aspect, the SPL signal 406 may be filtered, using a linear or non-linear filter. Specifically, the SPL signal 406 may go through a low-pass filter, to filter out sound content above a frequency threshold, which may be between 1 Hz and 100 Hz. In one aspect, the SPL signal 406 has been low-pass filtered. Low pass filtering the SPL signal may give a higher level of confidence that the hearable device is being inserted and/or placed on the user's ear, rather than a non-filtered SPL signal. This is because the non-filtered SPL signal may include pulses that are a result of a broader range of acoustic audio (e.g., audio sound having a frequency range of 20 Hz to 20 kHz). Removing spectral content above a low frequency, such as 100 Hz, reduces the chances that the pulses were the result of external audio, thereby reducing the number of potential false positives.

In one aspect, the controller 205 may process the obtained air pressure signal to detect at least one pulse therein for a period of time, e.g., one second, five seconds, ten seconds, in order to determine if the hearable device 200 is in a state of use. In some aspects, the controller 205 will intermittently monitor the air pressure signal for the period of time. For example, the controller 205 may process the air pressure signal for one period of time (e.g., 500 milliseconds), cease processing the air pressure signal for a following period of time (e.g., 10 seconds), and begin to process the air pressure signal for another period of time (e.g., 500 milliseconds). In one aspect, the controller 205 may deactivate the air pressure sensor 220 during periods of time in which the air pressure signal is not processed in order to conserve battery power.

As of yet the processing of the air pressure signal has been based on whether the signal includes at least one pulse. A spectral analysis, however, may further assist in determining whether the hearable device 200 is in a state of use by the user. Specifically, the controller 205 is to transform (or convert) the air pressure signal into the frequency domain, where the air pressure signal is represented by several frequency components (or bins), each defined by an energy level in which that particular frequency component contributes to the air pressure signal. In one aspect, the controller 205 may determine that the hearable device 200 is in a state of use when a low frequency bin has a higher energy level than at least some of the other frequency bins combined. For example, the controller 205 may determine an energy level of the frequency content of each of the several frequency components. The controller 205 determines that the hearable device 200 is in a state of use upon detecting that a low frequency component has a higher energy level than the energy levels of the other frequency components. In one aspect, the low frequency bin may include frequency content of the pressure signal up to a frequency threshold being between 1 Hz to 100 Hz. In some aspects, the low frequency bin may include only a portion of the frequency content between 1 Hz and 100 Hz (e.g., between 1 Hz and 20 Hz). In one aspect, the low frequency bin is said to have a higher energy level when the low frequency bin includes at least 51% of the total energy level of all frequency bins that contribute to the air pressure signal. In one aspect, this determination may be based on a comparison of one or more frequency bins, rather than all of them combined. In some aspects, rather than being with respect to the total energy level of all frequency bins, the low frequency bin may have a higher energy level than any one other frequency bin.

Graph 410 is a spectrogram, which is a visual representation of a spectrum of energy level of the signal at different frequency bins as they vary with time. Graph 410 illustrates the energy level between the same periods of time $t_1$-$t_2$ and $t_3$-$t_4$, as graphs 400 and 405. In each period of time, it shows that there is a significant amount of spectral energy below frequency threshold $\lambda_{th}$, illustrated as darker portions of the graph 410, as compared to the rest of the spectrogram. To determine whether the hearable device is in a state of use, the controller 205 is to determine where the most concentration of energy is within each of the frequency bins. Specifically, the controller 205 is to detect that a low frequency bin has a higher energy level (or more energy) than energy levels of the other frequency bins over the period of time. In one aspect, the frequency bin is below a frequency threshold, $\lambda_{th}$, which may be a frequency between 1 Hz and 100 Hz, as previously described.

In one aspect, the controller 205 may base the determination of whether the hearable device 200 is in use according to a particular amount of spectral energy detected within a period of time, rather than making the determination between time period $t_1$-$t_2$, which includes the spectral energy of the pulse 402 (and 407). To do this, the controller 205 may process the obtained air pressure signal for a period of time, e.g., one second, five seconds, ten seconds, etc., in order to determine if the hearable device 200 is in a state of use. In one aspect, as later described in FIG. 6, the controller 205 may begin to monitor the spectral content, upon a determination that the distance indicated by the proximity signal is less than a threshold distance. Referring to graph 410, the controller 205 may begin to monitor the spectral energy at a time before $t_1$, and continue to monitor the spectral energy until it exceeds a threshold (e.g., $\lambda_{th}$) consistently for one or more smaller segments of time (e.g., ten millisecond segments). In one aspect, the controller 205 may monitor the energy for the entirety of the period of time. In one aspect, the determination may be made when the spectral content exceeds the threshold within one or more sequential segments or one or more intermittent segments (e.g., the 10 millisecond segments being spaced apart every 100 milliseconds).

Returning to FIG. 3, the process 300 determines if there is a detected change in the air pressure, which indicates that the hearable device 200 is likely being used by the user, such as in a state of use being in the ear of the user and/or on (or over) the ear of the user (at decision block 315). Specifically, the controller may base this decision upon, for example and as described above, whether at least one pulse was detected in the air pressure signal, a majority of the sound energy within the air pressure signal is below a frequency threshold, and/or whether the air pressure within the user's ear is above a threshold. In one aspect, the decision may be based on at least one of the graphs illustrated in FIG. 4.

If it is determined that there is a detected change in the air pressure signal that indicates that the hearable device 200 is in use, the process 300 activates the hearable device 200 by performing at least one of (1) outputting an audio signal through the speaker 230 signifying that the hearable device 200 is in use, (2) establishing a wireless connection (e.g., pairs) with another electronic device, such as a media playback device to exchange data, or a combination thereof (at block 320). Specifically, the controller, in response to determining that the user is trying to use the hearable device, will take the hearable device out of the power-save mode, and activate the hearable device by managing various processing operations, such as networking and/or audio rendering operations, as previously described. In one aspect, to output the audio signal, the controller 205 will retrieve the audio signal from local memory (e.g., memory within the controller 205). While, in some aspects, the controller 205 will retrieve the audio signal remotely, via the network interface 235. If, however, the air pressure signal does not indicate that the hearable device 200 is in use, for example, there is no pulse, the majority of the sound energy is not below the frequency threshold, and/or the air pressure is not above the threshold, the process 300 ends.

Some aspects perform variations of the process 300. For example, the specific operations of the process 300 may not be performed in the exact order shown and described. The specific operations may not be performed in one continuous series of operations, and different specific operations may be performed in different aspects. In one aspect, rather than ending the process 300 if it is determined at decision block 315 that no change in air pressure is detected, the process 300 may return to block 310 to continue to process the obtained air pressure signal. In one aspect, the air pressure signal will be processed until a change is detected, or it may be processed for a particular amount of time (e.g., two seconds).

Figure 5:
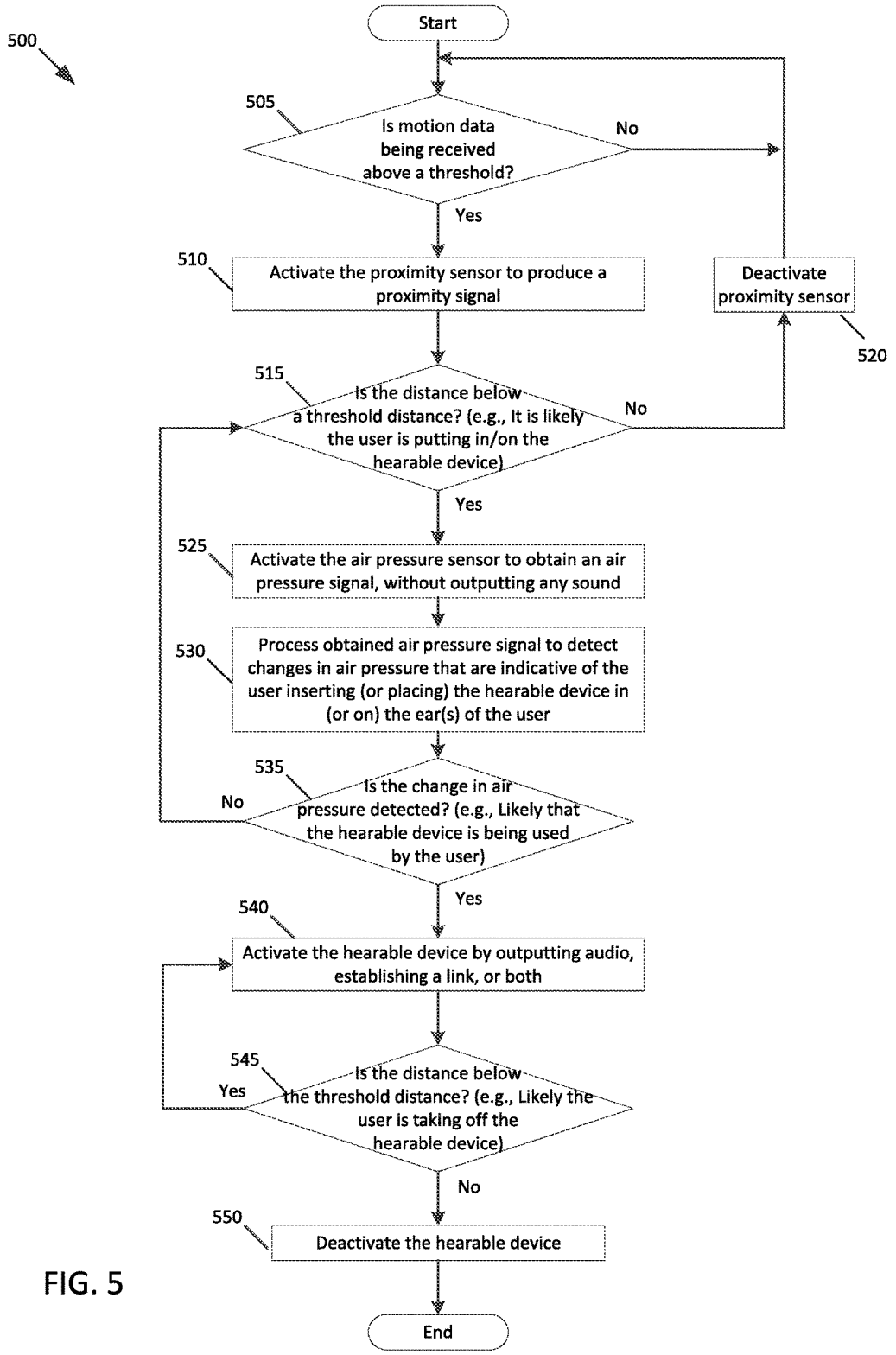
FIG. 5 is a flowchart of another aspect of a process to activate the hearable device based on changes in air pressure.

FIG. 5 is a flowchart of one aspect of a process 500 to activate a hearable device upon a determination that the hearable device is in a state of use according to changes in air pressure. In one aspect, the process 500 is performed by either of the hearable devices 100, 200, as described in FIGS. 1-2. The process 500 will be described by reference to FIGS. 2-3. For instance, some operations described in process 500, such as blocks 525-540, may be the same or similar to operations 305-320 described in process 300 of FIG. 3, respectively. In FIG. 5, the process 500 begins by determining if motion data is being received from the motion sensor 210, and if so, if it is above a threshold level (at decision block 505). Specifically, the motion sensor 210 sends motion data to the controller 205, which then determines if the hearable device 200 is moving at a velocity that is above a threshold velocity.

In one aspect, along with this determination the controller 205 may also determine if the velocity remains above that threshold for a period of time (e.g., one second, two seconds, etc.). In which case if the hearable device 200 is moving above the threshold velocity for the period of time, it may be assumed that the hearable device 200 is being picked up (e.g., from a table) by the user in order to wear the hearable device 200. If the velocity does not stay above the threshold velocity for the period of time, the process 500 continues to monitor motion data and returns to the decision block 505. In one aspect, at this step the hearable device 200 may be in the power-save mode. During this mode, the controller 205 may continue to monitor the motion sensor data while keeping other sensors and/or operations of the hearable device 200 offline. This may be due to the fact that the motion sensor 210 consumes less power than the other sensors.

If, however, the controller 205 determines that the velocity is above the threshold velocity (and for at least the period of time), the process 500 proceeds to activate the proximity sensor 215 to sense the presence of an external nearby object and produce a proximity signal that represents the distance between the external nearby object and the hearable device 200 (at block 510). In one aspect, the proximity sensor 215 may consume more power than the motion sensor 210. Therefore, the proximity sensor 215 may remain inactive (or off) until it is determined that the hearable device 200 is in motion as described in block 505 in order to conserve power.

The process 500 determines if the distance between the hearable device 200 and the external nearby object is lower than a threshold distance such that the user of the hearable device 200 is likely to be putting the hearable device in, on, or over the user's ear(s) (at decision block 515). Specifically, the proximity sensor 215 monitors the proximity signal from the proximity sensor 215 to detect if an external nearby object is close or getting close to the hearable device 200. As previously described, the threshold distance may be a small distance (e.g., ½ an inch) since while in use the hearable device 200 will be very close to a side of a user's head. In one aspect, the controller 205 may make this determination based on whether the distance has been within the threshold distance for a period of time (e.g., one second, two seconds, etc.). In one aspect, rather than determine if the distance is within a threshold distance, the controller 205 may determine whether the distance decreases below a certain rate. Specifically, as the user attempts to put on the hearable device 200, it may be assumed that the user will do so in a controlled manner in order to correctly align the hearable device into (or on) the user's ear(s). Thus, if the distance is within the threshold and/or the distance changes below a certain rate, it may be assumed that the user is attempting to wear the hearable device.

Returning to process 500, if the distance is not below the threshold distance, the process 500 deactivates the proximity sensor 215 and returns to decision block 505 (at block 520). Since the detected object is too far away, it is assumed that the user is not putting the hearable device 200 in/on the user's ear(s). In one aspect, the process 500 may wait a period of time e.g., five seconds, in order to give the controller 205 enough time to detect if the user is trying to use the hearable device 200 before proceeding to make the decision at decision block 515. Thus, the controller 205 will wait the period of time and continue to process the proximity signal to determine whether it is below the threshold. In one aspect, if the proximity signal indicates that there is no nearby external object (e.g., an object is too far away for the proximity sensor to determine its distance from the hearable device 200), the process 500 proceeds to block 520.

In response, however, to the distance being lower than the threshold distance, the process 500 activates the air pressure sensor 220 to begin sensing the air pressure to produce an air pressure signal (at block 525). In some aspects, the air pressure sensor 220 is activated, such that the air pressure sensor 220 senses the air pressure within the ear of the user (e.g., inside the ear canal or inside the inner ear), and produces an air pressure signal. As previously described, conventional approaches may activate a device once the distance associated with the proximity signal is below a threshold. This approach, however, is prone to false positives. Therefore, rather than rely solely on the proximity signal, the air pressure signal produced by the air pressure sensor 220 is a secondary source of confirmation that the hearable device 200 is in use.

The process 500 processes the obtained air pressure signal to detect changes in the air pressure that are indicative of the user inserting the hearable device 200 inside of the ear of the user, or placing the hearable device on top of (or over) the ear of the user (at block 530). The process 500 determines if there is a detected change in the air pressure, which indicates that the hearable device 200 is likely being used by the user, such as in a state of use being in the ear of the user and/or on the ear of the user (at decision block 535). If the air pressure signal does not include at least one pulse, the majority of the sound energy is not below the frequency threshold, and/or the air pressure is not above the threshold, the process 500 returns to decision block 515 to determine if the external nearby object is still within the threshold distance. In one aspect, upon returning to decision block 515, the controller 205 may deactivate the air pressor sensor 220 to conserve power. If, however, it is determined that there is a detected change in the air pressure signal that indicates that the hearable device 200 is in use, the process 500 activates the hearable device 200 by performing at least one of (1) outputting an audio signal through the speaker 230 signifying that the hearable device 200 is in use, (2) establishing a wireless connection (e.g., pairs) with another electronic device, such as a media playback device to exchange data, or a combination thereof (at block 540).

Now that it has been determined that the user wants to use the hearable device, the controller 205 is to monitor sensor data to detect when the user removes the hearable device 200. For example, the user may have put on the hearable device 200 in order to make a handsfree phone call. After the phone call, the user may remove the hearable device 200, and put it in a pocket, as shown in FIG. 1. To do this, the controller 205 is to monitor the proximity sensor signal (data) produced by the proximity sensor 215 to detect if there has been a change in the distance between the external object, which in this case would be the user's head, and the hearable device 200. The process 500 determines if the distance between the external nearby object and the hearable device 200 is still within the threshold distance (at decision block 545). For example, as previously described, the controller obtains the proximity sensor data outputted by the proximity sensor 215 that represents a distance between the hearable device and an object external to the hearable device. If the distance remains below the threshold distance, this means that the hearable device 200 is still being used by the user. In this case, the process 500 returns to block 540 to keep the hearable device 200 active.

If, however, it is determined that the distance is above the threshold distance, the process 500 deactivates the hearable device 200 by putting it back into power-save mode (at block 550). Specifically, when the hearable device 200 is paired with another device, the controller 205 terminates the wireless connection with the other device in response to detecting that the hearable device is no longer on-ear or in-ear based on the determination that the distance is above the threshold distance. In one aspect, the hearable device may signify to the other device that it is going into a power-save mode. For instance, the controller 205 may send a message to the other device indicating that it is terminating the communication link and therefore will not be exchanging data with the device. In one aspect, the controller 205 may simply terminate the communication link without informing the other device. In this case, the other device may continue to transmit data, until a certain period of time in which no reply is received from the hearable device 200.

Some aspects perform variations of the process 500. For example, the specific operations of the process 500 may not be performed in the exact order shown and described. The specific operations may not be performed in one continuous series of operations, and different specific operations may be performed in different aspects. In one aspect, rather than activating the proximity sensor 215 and/or the air pressure sensor 220 at blocks 510 and 525, respectively, the sensors may already be activated and producing sensor data. Thus, at these blocks, the process 500 may obtain the signals already being produced by these sensors and begin processing the signals. In some aspects, the process 500 may solely rely on the air pressure signal produced by the air pressure sensor 220 to determine whether the hearable device is in use, as described in FIG. 3. In one aspect, the air pressure sensor 220 may remain active to constantly produce an air pressure signal, or the air pressure sensor 220 may sense air pressure intermittently (e.g., for 500 milliseconds, every 2 seconds, as previously described). Thus, operations 505-520 may be omitted from the process 500 entirely.

Figure 6:
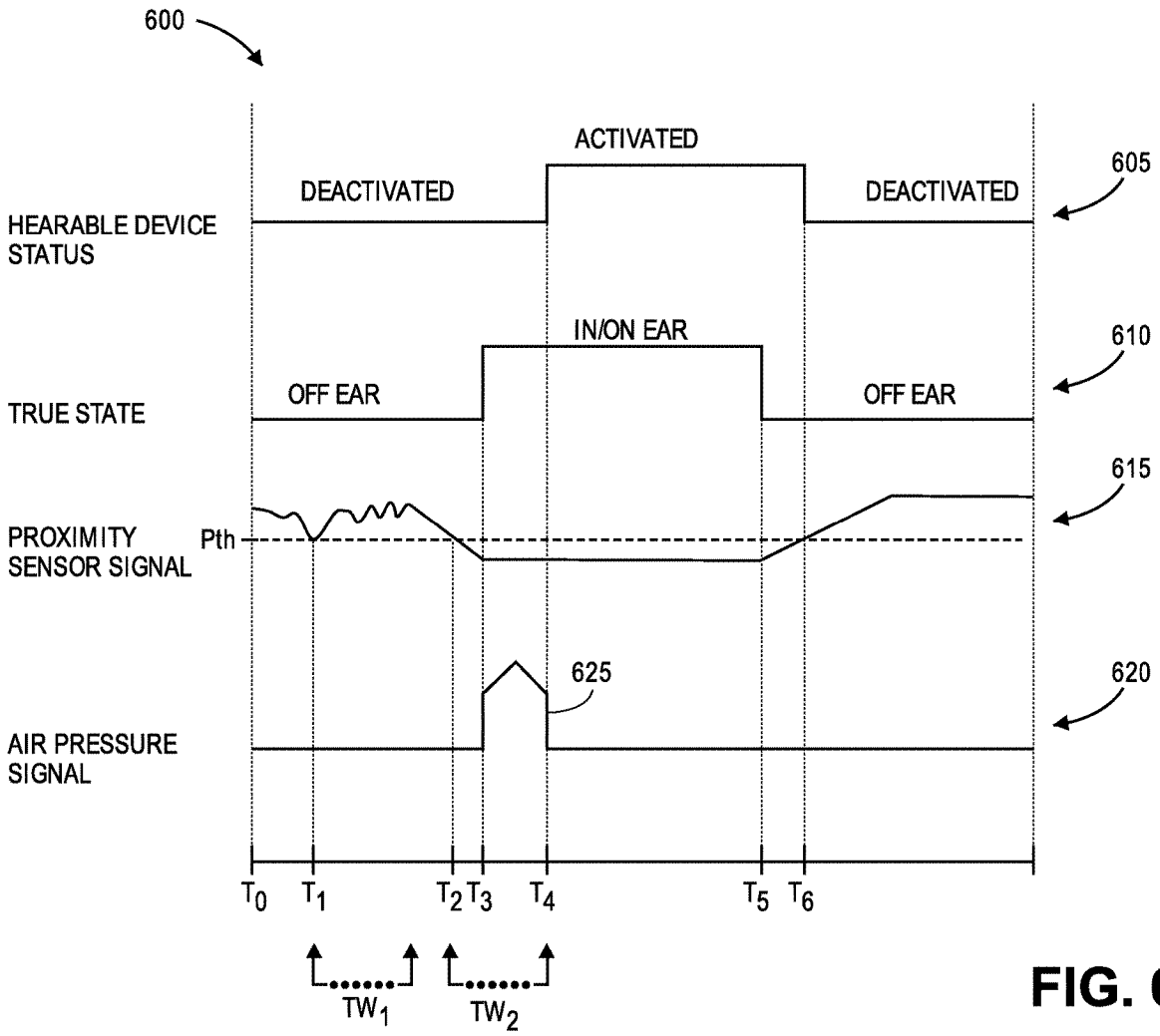
FIG. 6 shows a diagram that illustrates a visual relationship between sensor data and a current state of the hearable device.

FIG. 6 shows a diagram 600 that illustrates a visual relationship between sensor data and a current state of the hearable device 200. This figure illustrates how the air pressure sensor 220 provides a higher level of confidence that the hearable device 200 is in use by being a secondary source of confirmation to that of the proximity sensor 215. The diagram 600 includes four graphs, each graph with respect to time. The first graph 605 is the active status (e.g., either deactivated or activated) of the hearable device 200. The second graph 610 illustrates a "true state" of the hearable device 200. In one aspect, the true state is defined as one of two states: 1) "off-ear" in which the hearable device 200 is not being worn by the user, and 2) "in/on-ear" in which the hearable device 200 is in a state of use being inserted into the user's ear and/or on top of (or over) the ear of the user. The third graph 615 is of the proximity sensor signal produced by the proximity sensor 215; and the fourth graph 620 is the air pressure signal produced by the air pressure sensor 220.

In one aspect, the air pressure sensor 220 provides a secondary confirmation that the hearable device is in use by limiting any false positives that may otherwise occur if the hearable device 200 were to only use the proximity sensor 215 for confirmation. The following is a chronological discussion of the diagram 600. At $T_0$, the hearable device 200 is not being worn by the user and is deactivated (e.g., in power-save mode). At this time, the proximity sensor 215 is active and is producing a proximity sensor signal. In one aspect, $T_0$ may be at block 510 of process 500 of FIG. 5. At $T_1$, the proximity sensor signal in graph 615 indicates that a distance between the hearable device 200 and a nearby object is below a distance threshold $P_{th}$, which indicates that the user may likely be putting on the hearable device 200. In response, the controller 205 processes the air pressure signal during a time window $TW_1$. In one aspect, this window of time may be a predefined length of time, e.g., ½ second, ¾ second, one second, two seconds, etc. In another aspect, this window of time is learned through a machine learning algorithm based on the amount of time it usually takes the user to put on the hearable device 200. During this window of time, however, the controller 205 does not detect a change in the air pressure within the air pressure signal in graph 620. Also, during $TW_1$, graph 615 indicates that the proximity sensor signal has increased above the distance threshold. The decrease and sudden increase in the proximity sensor signal may be a result of an object moving past the hearable device 200 rather than the user attempting to wear the device 200. Thus, if the hearable device 200 relied solely on the proximity sensor signal, it may have activated at time $T_1$, thereby creating a false positive.

Once again, at $T_2$ the proximity sensor signal in graph 615 passes below the threshold, and in response the controller 205 begins to process the air pressure signal during a second time window, $TW_2$. But, as opposed to the false positive at $T_1$, this time the user is putting on the hearable device 200 to use the device (e.g., in a handsfree phone call). This can be evident from the fact that the graph 615 of the proximity sensor signal is slowly decreasing down to a minimum distance. Simultaneously (or immediately thereafter), the controller 205 begins to process the air pressure signal within $TW_2$. At $T_3$, the user has put on (or is putting on) the hearable device 200 and now the true state of the hearable device 200 is in/on-ear, as shown in graph 610. As a result, the controller 205 detects a pulse 625 that is caused by the pressure difference as the hearable device 200 is being put in/on the user's ear. Once the pulse 625 is detected, there is a high level of confidence that the hearable device 200 is in/on the ear of the user. Therefore, the active status of the hearable device 200 in graph 605 transitions from being deactivated (or being in the power-save mode) to being activated at $T_4$.

Between $T_3$ and $T_5$, the hearable device 200 is in use by the user. At $T_5$, however, the user has finished using the hearable device 200 and takes it off changing its true state to the off-ear state. As the device 200 is being taken off, the distance indicated by the proximity sensor signal begins to rise indicating that the distance between the hearable device and the user's head is increasing. Once this distance surpasses the threshold distance at $T_6$, it may be assumed that the user is taking off the hearable device 200. As a result, the hearable device deactivates (or switches back to the power-save mode).

As previously explained, an aspect of the invention may be a non-transitory machine-readable medium (such as microelectronic memory) having stored thereon instructions, which programs one or more data processing components (generically referred to here as a "processor") to perform the network operations, signal processing operations, audio signal processing operations, and sound pickup operations. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by a processor of an earphone for determining a current usage state of the earphone that comprises a speaker and an air pressure sensor, the method comprising:

determining, using a proximity sensor, that a distance between the earphone and an object external to the earphone is lower than a threshold distance;

in response to determining that the distance is lower than the threshold distance, activating the air pressure sensor to begin sensing air pressure proximate to the earphone;

obtaining a pressure signal from the air pressure sensor that indicates air pressure proximate to the earphone, the air pressure sensor produces the pressure signal in response to the earphone being inserted into an ear of a user;

processing the obtained pressure signal to determine that the earphone is in a state of use, and in response, performing at least one of (1) outputting an audio signal through the speaker signifying that the earphone is in use, (2) establishing a wireless connection with a media playback device to exchange data between the earphone and the media playback device, or combination thereof.

2. The method of claim 1, wherein processing the obtained pressure signal to determine that the earphone is in the state of use comprises detecting that the pressure signal has at least one pulse.

3. The method of claim 2, wherein the at least one pulse within the pressure signal is detected over a period of time having a range of 50 milliseconds to 500 milliseconds.

4. The method of claim 3, wherein processing the obtained pressure signal comprises generating a sound pressure level (SPL) signal from the pressure signal and detecting at least one pulse within the SPL signal, wherein the pulse exceeds an SPL threshold value that is between 20 dB and 50 dB.

5. The method of claim 1, wherein determining that the earphone is in the state of use comprises transforming the pressure signal into a plurality of frequency components;

determining an energy level of each of the plurality of frequency components;

detecting that a low frequency component of the plurality of frequency components has a higher energy level than a high frequency component of the plurality of frequency components.

6. The method of claim 5, wherein the low frequency component is between 1-100 Hz.

7. A hearable device comprising a housing;

a processor;

a speaker;

a proximity sensor;

an air pressure sensor, wherein the speaker and the air pressure sensor are integrated into the housing; and memory having stored therein instructions which when executed by the processor cause the hearable device to determine, using the proximity sensor, that a distance between the hearable device and an object external to the hearable device is lower than a threshold distance;

in response to determining that the distance is lower than the threshold distance, activate the air pressure sensor to begin sensing air pressure proximate to the hearable device;

obtain a pressure signal from the air pressure sensor that indicates air pressure proximate to the hearable device, the air pressure sensor produces the pressure signal in response to the hearable device being inserted into or placed against an ear of a user;

process the obtained pressure signal to determine that the hearable device is in a state of use being against the ear or inside of the ear of the user, and in response, performing at least one of (1) outputting an audio signal through the speaker signifying to the user that the hearable device is in use, (2) establishing a wireless connection with a media playback device to exchange data between the hearable device and the media playback device, or combination thereof.

8. The hearable device of claim 7, wherein the instructions to process the obtained pressure signal to determine that the hearable device is in a state of use comprises instructions to detect that the pressure signal has at least one pulse.

9. The hearable device of claim 8, wherein the at least one pulse within the pressure signal is detected over a period of time having a range of 50 milliseconds to 500 milliseconds.

10. The hearable device of claim 9, wherein the instructions to process the pressure signal comprises instructions to generate a sound pressure level (SPL) signal from the pressure signal and detect at least one pulse within the SPL signal, wherein the pulse exceeds an SPL threshold value that is between 20 dB and 50 dB.

11. The hearable device of claim 7, wherein the instructions to determine the hearable device is in a state of use comprises instructions to transforming the pressure signal into a plurality of frequency components;

determining an energy level of each of the plurality of frequency components;

detecting that a low frequency component of the plurality of frequency components has a higher energy level than a high frequency component of the plurality of frequency components.

12. The hearable device of claim 11, wherein the low frequency component is between 1-100 Hz.

13. The method of claim 1, wherein the earphone further comprises a motion sensor, wherein the method further comprises:

obtaining, from the motion sensor, motion data that indicates the earphone is moving; and in response to obtaining the motion data, activating the proximity sensor to begin sensing a presence of external nearby objects.

14. The hearable device of claim 7 further comprising a motion sensor, wherein the memory further stores instructions that when executed by the processor causes the hearable device to obtain, from the motion sensor, motion data that indicates the earphone is moving; and in response to obtaining the motion data, activate the proximity sensor to begin sensing a presence of external nearby objects.

15. A method performed by a processor of an earphone for determining a current usage state of the earphone that includes a speaker and an air pressure sensor, the method comprising:

obtaining a pressure signal from the air pressure sensor that indicates air pressure proximate to the earphone, the air pressure sensor produces the pressure signal in response to the earphone being inserted into an ear of a user;

processing the obtained pressure signal to determine that the earphone is in a state of use by detecting that the pressure signal has at least one pulse over a period of time having a range of 50 milliseconds to 500 milliseconds, and in response, performing 1) outputting an audio signal through the speaker signifying that the earphone is in use or 2) establishing a wireless connection with a media playback device to exchange data between the earphone and the media playback device.

16. The method of claim 15, wherein the earphone further comprises a proximity sensor, wherein the method further comprises:

determining, using the proximity sensor, that a distance between the earphone and an external object is lower than a threshold distance; and in response to the distance being lower than the threshold distance, activating the air pressure sensor to begin sensing the air pressure.

17. The method of claim 15, wherein processing the obtained pressure signal comprises generating a sound pressure level (SPL) signal from the pressure signal and detecting a pulse within the SPL signal, wherein the pulse exceeds an SPL threshold value that is between 20 dB and 50 dB.

18. The method of claim 15, wherein the air pressure sensor produces the pressure signal while the speaker is not driven by an audio signal to produce sound.

19. The method of claim 15, wherein processing the obtained pressure signal comprises:

transforming the pressure signal into a plurality of frequency components;

determining an energy level of each of the plurality of frequency components;

detecting that a low frequency component of the plurality of frequency components has a higher energy level than a high frequency component of the plurality of frequency components.

20. The method of claim 19, wherein the low frequency component is between 1-100 Hz.

* * * * *